US005195516A

United States Patent [19]

Grimsey

[11] Patent Number: 5,195,516

[45] Date of Patent: Mar. 23, 1993

[54] BREATHING GAS RECIRCULATION APPARATUS WITH REDUCED WORK OF BREATHING

[75] Inventor: Peter K. Grimsey, Aberdeen, Scotland

[73] Assignee: Gas Services Offshore Limited, Aberdeen, Scotland

[21] Appl. No.: 469,507

[22] PCT Filed: Sep. 2, 1988

[86] PCT No.: PCT/GB88/00725

§ 371 Date: Apr. 12, 1990

§ 102(e) Date: Apr. 12, 1990

[87] PCT Pub. No.: WO89/01895

PCT Pub. Date: Mar. 9, 1989

[30] Foreign Application Priority Data

Sep. 2, 1987 [GB] United Kingdom ..... 8720663

[51] Int. Cl.[5] ..... A61M 16/00; A62B 7/04; A62B 7/10

[52] U.S. Cl. ..... 128/204.26; 128/205.13; 128/205.17; 128/205.12

[58] Field of Search ..... 128/205.13, 205.17, 128/204.18, 204.26, 204.28, 205.12

[56] References Cited

U.S. PATENT DOCUMENTS

| | | | |
|---|---|---|---|
| 2,677,371 | 5/1954 | Serra | 128/205.17 |
| 3,556,098 | 1/1971 | Kanwisher | 128/202.22 |
| 3,890,967 | 6/1975 | Elam et al. | 128/205.17 |
| 3,921,628 | 11/1975 | Smythe et al. | 128/204.21 |
| 3,923,053 | 12/1975 | Jansson | 128/205.12 |
| 4,154,234 | 5/1979 | Baker | 128/205.12 |
| 4,299,216 | 11/1981 | Bernard et al. | 128/205.12 |
| 4,377,163 | 3/1983 | Feathers | 128/205.24 |
| 4,811,732 | 3/1989 | Hartung | 128/205.17 |

OTHER PUBLICATIONS

"A Clinical Guide to Cardiopulmonary Medicine", Cress et al., Printed by Puritan-Bennett Corporation, pp. 16, 17.

*Primary Examiner*—David A. Wiecking
*Assistant Examiner*—Kimberly L. Asher

[57] ABSTRACT

A breathing apparatus is provided for use, particularly by divers, in recirculation of a breathing gas. The apparatus has a supply line for supply of gas to a user and a return line for return of exhaust gas from the user to be recirculated. Two gas chambers of variable volume, a first in the supply line and a second in the return line, are capable of changing volume in unison with the user's breathing to accommodate a change in gas volume in the apparatus due to the user's breathing action. The first and second chambers are constrained to operate together in such a way that the variation of volume of either chamber is accompanied by a similar variation in the volume of the other chamber. Thus, both chambers would be full together (maximum operational volume) and empty together (minimum operational volume). Preferably, the variable volume chamber is in the form of a counterlung. For example, a pair of linked counterlungs may be used, or preferably a double counterlung comprising a single body with two separate chambers could be employed.

7 Claims, 11 Drawing Sheets

BREATHING GAS RECIRCULATION APPARATUS WITH REDUCED WORK OF BREATHING

BACKGROUND OF THE INVENTION

1. Technical Field

The present invention relates to breathing gas recirculation.

2. Background Information

One type of recirculation system is a gas reclaim system in which breathing gas is supplied at pressure to the user and the user's exhaust gases are recovered, reprocessed and pumped back to the user. Another type of recirculation system is a closed circuit rebreather system in which as the user breathes each breath is passed through a reprocessing circuit and returned to the user. A further type of recirculation system is a semi-closed circuit system in which part of the exhaust gases are recycled to the user, topped up with fresh breathing gas, and excess gas is expelled from the system.

In the case of a reclaim system the gas is mechanically driven around the breathing circuit; in a rebreather system the breathing action of the user has to drive the gas around the circuit. In all cases it is vital to supply adequate gas to the user without requiring him to exert great effort in breathing. A critical factor in the acceptability of any breathing apparatus to the user is the work of breathing (WOB) required: a high WOB will lead to discomfort and fatigue for the user, and may provide insufficient gas flow during heavy breathing, exertion and the like.

A large part of the WOB of any breathing gas recirculation system is associated with the energy absorbed by changes in gas flow through hoses, valves and other associated parts of the breathing apparatus. Both changes in flow rate and changes in flow direction increase the WOB.

As a user of a breathing gas recirculating apparatus breathes in and out the changes in gas flow cause pressure swings within the system. The present invention aims to minimise the pressure swings in a gas recirculation system and to provide an improved breathing gas flow to and from a user of a recirculation system. The advantages which result from this are a low system pressure drop over the breathing cycle and a low breathing resistance, hence a low WOB. The present invention aims to accommodate changes in gas flow due to the user's breathing action and thus to provide a breathing apparatus which allows a substantially constant gas flow for recirculation.

It is known to include in a breathing gas recirculation system a chamber of variable volume to accommodate breathing gas and which is capable of expanding and contracting in response to displacement of the user's own lungs which causes pressure swings in the breathing circuit. Such chambers are commonly made (at least partly) of a compliant material and are known in the art as counterlungs or breathing bags.

SUMMARY OF THE INVENTION

The present invention provides a breathing apparatus for use in recirculation of breathing gas and having a supply line for supply of gas to a user and a return line for return of exhaust gas from the user to be recirculated; the apparatus having two gas chambers of variable volume, a first in the supply line and a second in the return line; the chambers in the supply and return lines being capable of changing volume in unison with the user's breathing to accommodate a change in gas volume in the apparatus due to the user's breathing action; the first and second chambers being constrained to operate together in such a way that the variation of volume of either the first or second chamber is accompanied by a similar variation in the volume of the other chamber. Thus, both the supply- and return-line chambers would be full together (maximum operational volume), and both would be empty together (minimum operational volume).

Preferably the apparatus would be provided with a valve to shut off the supply line when the chambers contain their maximum operational volume of breathing gas and a valve to shut off the return line when the chambers contain their minimum operational volume (known as residual volume).

Preferably the variable volume is in the form of a counterlung. For example, a pair of linked counterlungs may be used, or preferably a double counterlung comprising a single body with two separate chambers may be used; the essential requirement is that the volume of gas in both chambers varies in unison so that both the supply- and return-line chambers become filled at the same time and become emptied at the same time.

The effect of using the apparatus of the invention is as follows: The user's breathing action causes cyclic increases and decreases in the gas flow in the supply and return lines between the user and the chambers. On the exhale part of a breathing cycle the chambers initially contain a relatively low volume of breathing gas. As the user breathes out the exhaled gas flows along the return line into the return line chamber and tends to increase its volume; gas flowing out from this chamber is recirculated. At the same time recirculated gas flows back towards the user along the supply line into the supply line chamber and as the gas is not being used it tends to increase the volume of the supply line chamber. At the end of the exhale cycle the chambers both contain a relatively high volume of breathing gas. On the inhale part of the breathing cycle the user inhales gas which flows along the supply line and this tends to reduce the volume of gas contained in the supply line chamber. At the same time gas from the return line chamber flows along the return line away from the user to be recirculated and this tends to reduce the volume of gas contained in the return line chamber. At the end of the inhale cycle the chambers again both contain a relatively low volume of breathing gas, and a full cycle has been completed.

The invention will now be described in detail by way of example only. The examples and embodiments all illustrate use of the invention as breathing apparatus for divers and recirculation systems for divers' breathing gas. It is to be understood that the field of application of the invention is not to be construed as limited to diving only, but could include any field of application where breathing gas recirculation is employed—e.g. fire-fighting, protection from noxious or toxic fumes and the like. Reference will be made to the accompanying schematic drawings.

DETAILED DESCRIPTION OF THE INVENTION

Figure 1:
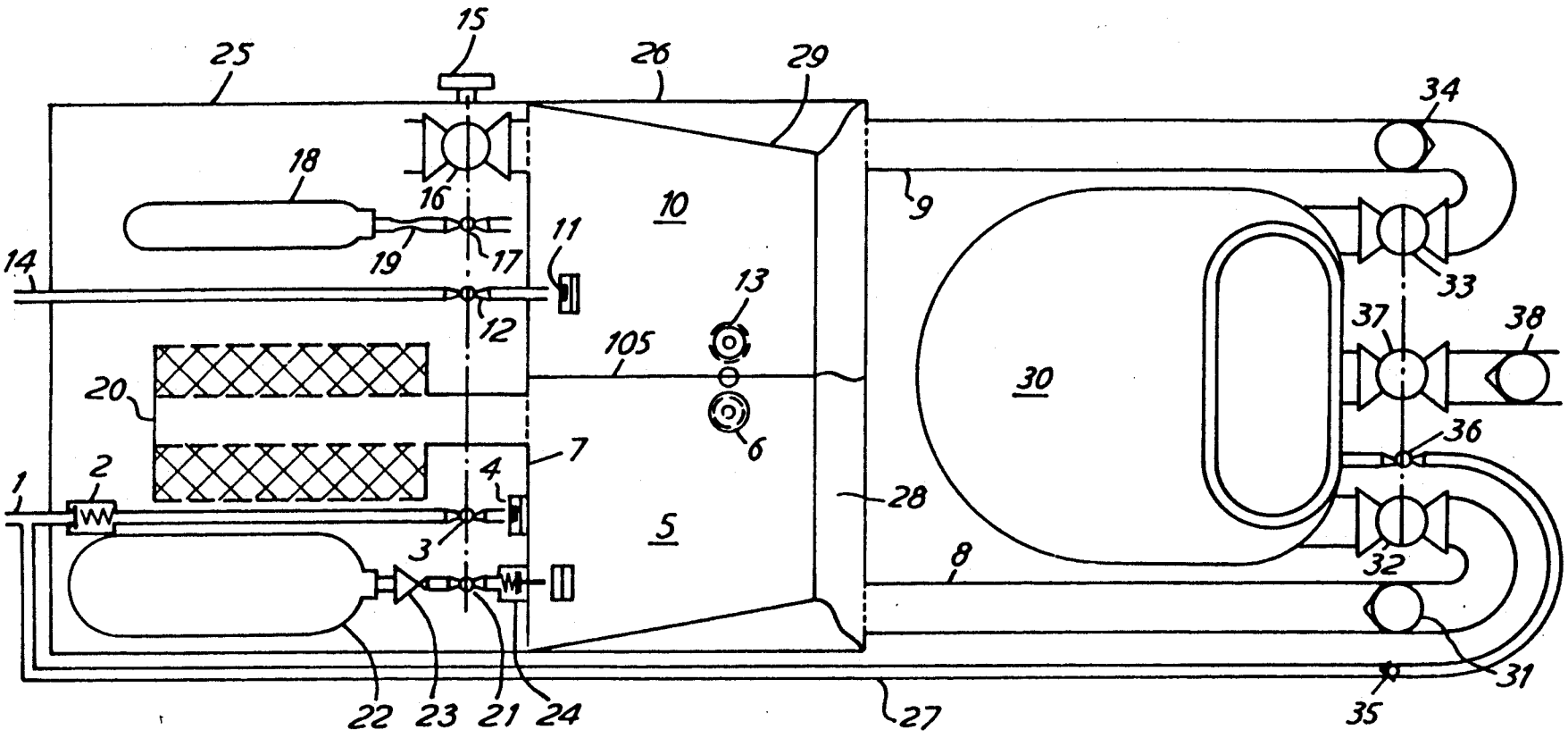
FIG. 1 illustrates a backpack and helmet.

FIG. 1 illustrates a design for a backpack 25,26 and modified helmet 30 for use in a diver's gas reclaim system. The backpack incorporates a rebreather facility as a bailout i.e. the diver's gas can be reprocessed in the backpack if the main system fails. Three systems will be described which could incorporate the backpack. These are a surface mounted system specifically for use with the backpack, a system using existing gas reclaim systems with minor modifications, and a submersible mounted system.

GENERAL DESIGN

Principles of Operation

The key to the system is in a double counterlung 5,10 mounted in the backpack (FIG. 1). This expands and contracts to accommodate the diver's breathing. It is used in conjunction with the main gas reclaim system and the rebreather bailout. The double counterlung can also be isolated from the helmet 30 if there is a failure in the backpack. If this occurs the helmet is operated in a free flow mode, wherein gas is flowing through the system without being controlled by the user's demand for gas.

BACKPACK AND HELMET

The backpack is divided into two sections: an open section 26 in which the counterlung 5,10 is situated, and a sealed section 25 containing the other backpack components.

Water can flow freely in and out of the open section 26 to accommodate the expansion and contraction of the counterlungs 5,10. The sealed portion 25 can be opened to allow for charging of cylinders, replacement of $CO_2$ removing agent and general maintenance, but when in use is sealed against the ingress of water.

In the normal gas recovery mode, gas flows from a supply umbilical hose 1 through a loaded non-return valve 2, manual supply valve 3 and an automatic supply valve 4 in and into the sealed portion 25 of the backpack. The valve 4 is controlled by the supply counterlung 5 and is normally fully open. It is closed only when the counterlung 5 is full. Gas in the sealed backpack portion 25 flows through the supply counterlung 5 and a helmet supply hose 8 to the helmet 30. Gas flows from the helmet 30 through a helmet return hose 9, Gas flows from the helmet 30 through a helmet return hose 9, the return counterlung 10, an automatic return shut-off valve 11 and a manual return shut-off valve 12 to the gas return line 14. Both of the valves 11 and 12 are normally open. The valve 11 is closed automatically when the return counterlung 10 is empty. The valve 12 is closed manually if there is a system failure. The valve 12 is a safety feature and can be operated quickly in an emergency.

Ganged with the manual supply and return shut-off valves 3, 12 are a changeover handle 15 and bailout operating valves 16, 17. This ensures that the bailout, which is a separate back-up emergency supply system, cannot be operated without the return line 14 being shut off by valve 12. When the bailout is operating, the return counterlung 10 is open through the valve 16 to the sealed portion 25 of the backpack. The direction of gas flow is controlled by supply and return non-return valves 31,34 in the helmet 30. A $CO_2$ scrubber 20 is connected to the supply counterlung 5. The entrance to the $CO_2$ scrubber is situated so that the sealed section of the backpack would have to be nearly half full of water before the water can flow into the scrubber 20. This means that the backpack acts as a water trap to prevent saturation of the $CO_2$ scrubber bed by the water that is produced by the $CO_2$ scrubbing action and the user. An oxygen cylinder 18 with a metering device 19 replaces the oxygen used by the diver. A second cylinder 22 filled with breathing gas compensates for gas lost through the helmet and backpack. When the counterlung 5,10 reaches its empty state, it opens a valve 24 connected to the cylinder 22 by a valve 21, operated by the handle 15, in the bailout condition through a reducing valve 23. The volume of gas contained in the backpack and helmet combined with the added oxygen is chosen to be sufficient to ensure that the partial pressure of oxygen remains within safe limits for at least fifteen minutes and will keep the diver alive for at least thirty minutes.

Any demand type helmet can be suitably modified for the backpack. This is achieved by removing the demand valve and replacing it with a backpack isolating valve assembly connected into the hoses 8,9 to and from the backpack. It incorporates non-return valves which ensure the correct direction of flow through the hoses. The valve assembly is manually operated and it isolates the backpack from the helmet in the event of a backpack failure. The diver can then free flow gas into the helmet from the supply umbilical hose 1 through a hose 27, the non-return valve 35 and free-flow shut-off valve 36 of the assembly. The diver then exhales through a free-flow vent valve 37 of the valve assembly and a non-return vent valve 38. The valves 32,33,36 and 37 are ganged together for simultaneous operation. In the normal position, the valves 36 and 37 are closed and the valves 32 and 33 open.

With this arrangement at least two equipment failures must occur before there is a hazard to the diver. The equipment is also designed so that the diver can detect any failures of the primary or secondary breathing equipment before they become a hazard.

In order to heat the diver's gas the backpack and the hoses to the diver are covered by an insulating jacket through which hot water is pumped.

When the bailout rebreather is operating at extreme depths with heavy breathing it is probable that the work of breathing will be just within the recognised standards, and will be acceptable as a backup in case of an emergency. When the gas reclaim system is working the breathing resistance will be reduced by more than fifty percent. This is because the gas is being pumped through the backpack and helmet, whereas in the bailout mode the diver's breathing has to drive the gas round the rebreather, including through the $CO_2$ scrubber.

Backpack

The double counterlung 5,10 is the key to the system. Its main requirement is that the volume of gas in both counterlungs 5,10 always alters proportionally so that both the supply and return counterlungs become full at the same time, and are at their residual volume at the same time. The residual volume is the minimum volume that the counterlung will hold, i.e. when the counterlung is effectively empty. This is necessary because otherwise the supply counterlung would tend to be full and the return counterlung would tend to be empty, due to the drop in pressure which will occur between them as gas flows through the helmet and its hoses.

The secondary requirement of the double counterlung assembly is that it will shut off the return line 14 when it is empty and shut off the supply line 1 when it is full, with minimal change to the gas pressure in the counterlung, and that these lines can be opened again with a similar pressure change.

In one embodiment (illustrated in FIGS. 2 and 3) this can be achieved by constructing the double counterlung assembly around two stiff sheets. One sheet 42 is fixed to, or part of, the backpack. The other sheet 29 is joined to the backpack by a hinge 7 on which it pivots. The remaining sides of the counterlung assembly are flexible, including a partition 105 to separate the two counterlungs. The partition 105 is attached to the two sheets close to their centre-line 41. The flexible sides 28 could be of a simple membrane construction as shown in FIG. 4*a* or of a bellows construction 43 as shown in FIG. 4*b*. This bellows construction would be better at maintaining its shape. The movement of the hinged sheet 29 as the counterlung is filled and emptied of gas is used to shut the supply and return lines. The surface area of the exposed membrane is kept to a minimum to reduce the heat lost through it. It should be noted that the hinged sheet/diaphragm could have a variety of shapes and could be in various positions with respect to the fixed sheet.

Figure 2:
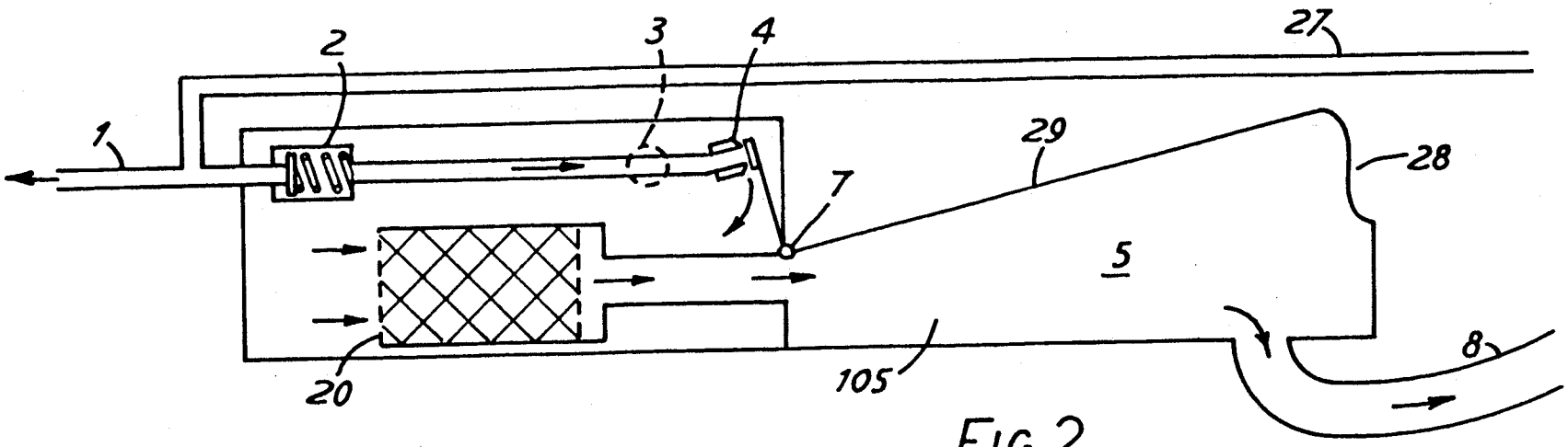
FIG. 2 illustrates a supply side part of a backpack in section.

FIG. 2 shows the supply counterlung incorporated in the backpack. Gas flows from the supply umbilical 1 through the loaded non-return valve 2, valve 3 and the supply shut-off valve 4 into the sealed backpack section 25. It then flows through the $CO_2$ scrubber 20 into the supply counterlung 5 and from the counterlung 5 through the supply hose 8 to the helmet. The non-return valve 2 is biased shut so that it does not open until the pressure in the umbilical 1 is sufficient for the helmet to operate in a free flow mode. The supply shut-off valve 4 closes when the supply counterlung 5 (and also the return counterlung 10) is full. It is held shut by the hinged sheet 29 of the counterlung. The large ratio between the area of the hinged sheet and the area of the valve seat together with the mechanical advantage about the hinge enables a very small increase in the counterlung gas pressure to hold the valve shut against a large pressure rise in the supply umbilical. The valve is of the down-stream type and therefore can only fail open.

Figure 3:
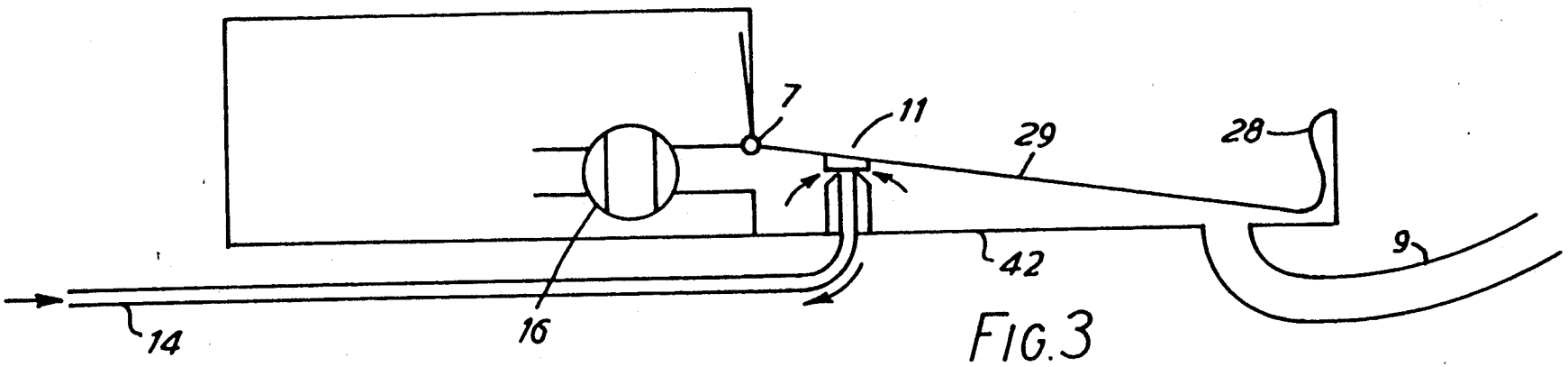
FIG. 3 illustrates a return side part of a backpack in section.
Figure 4B:
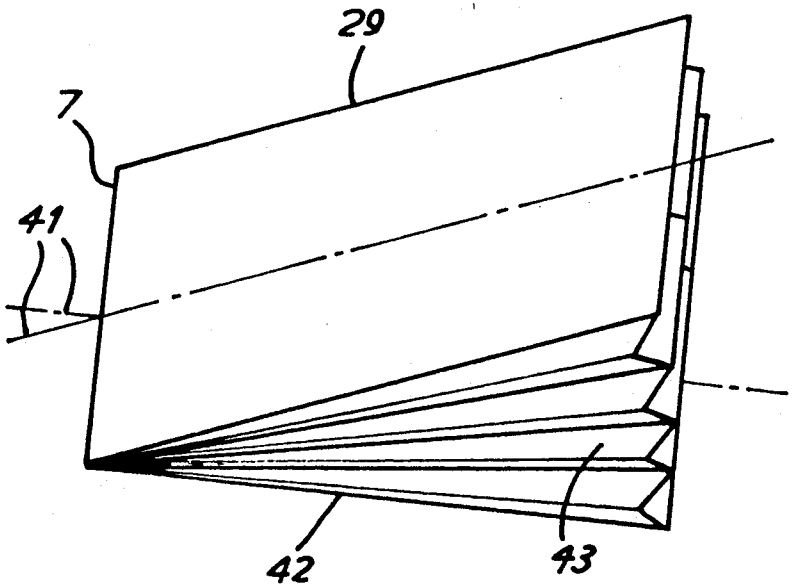
FIG. 4*b* illustrates an alternative double counterlung, with bellows sides.
Figure 4A:
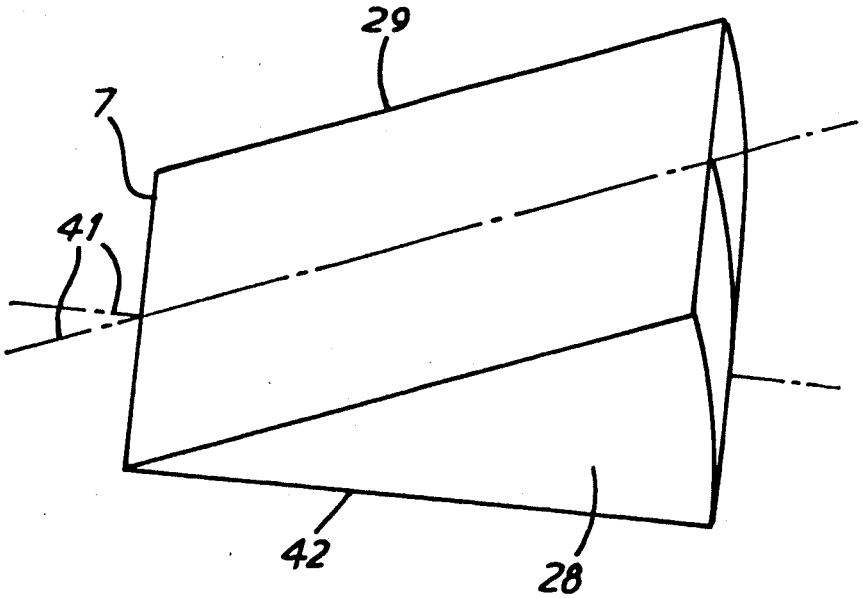
FIG. 4*a* illustrates a double counterlung with membrane sides.

FIG. 3 shows the return counterlung 10 incorporated in the backpack. Gas flows from the helmet 30 through the return hose 9 into the return counterlung 10 and then out to the return umbilical 14. A valve element 11 which is mounted on the hinged sheet of the counterlung shuts off the flow to the return umbilical when the umbilical is empty. This valve is an up-stream type and therefore can only fail shut. Pressure and suction relief valves 6,13 are mounted in the hinged sheet 29 close to the centre of the double counterlung since the ambient pressure here will normally equal the mean counterlung gas pressure. The valves 6,13 ensure that the helmet is not over- or under-pressurised sufficiently to hazard the diver. The ball valve 16 will connect the return counterlung to the sealed section of the backpack when it is used as a rebreather bailout.

Most of the components in the apparatus are commercially available. However, some components, whilst using proven technology, would be either commercially available components which were then modified, or components which were specially designed and manufactured. These are:

a) The counterlung
b) The backpack case
c) The backpack $CO_2$ scrubber
d) The oxygen cylinder gas flow metering device
e) The manual return line isolating valve and bailout valves
f) The backpack isolating valve
g) The gas recirculating pump.

The $CO_2$ scrubber is only necessary for the rebreather but is permanently in line. Because the gas supplied by the umbilical from the reclaim and recirculation system has a very low $CO_2$ content, the working life of the $CO_2$ scrubber will be relatively long. When the apparatus is being used as a rebreather the $CO_2$ in the diver's exhaled breath will be removed by the scrubber. Any leakage of seawater into the backpack—which would tend to destroy the effectiveness of the scrubber—will be noticed by the diver as he breathes and will warn him to cease his dive. The $CO_2$ scrubber is permanently in line so that should any water manage to get into the backpack the diver will be made aware of the build up of caustic moisture before it becomes a significant hazard. If this does happen he will be able to isolate the backpack and return to the submersible on free flow.

An assessment of the work of breathing of the reclaim system (1,14) can be made by comparing it to that of the rebreather (bailout). Work which has been done with existing rebreather systems shows that at 500 meters these are at best only acceptable as back up systems due to the work of breathing. The cause of the work of breathing can be divided into three sources of pressure drop in the circuit:

1. The $CO_2$ scrubber
2. The supply pipework
3. The return pipework

Each of these makes a similar contribution to the work of breathing of the rebreather. This is not the case with the reclaim system.

In the case of the diver not breathing with the rebreather there will be no flow through the helmet and the helmet pressure will be the same as in both counterlungs. In the case of the diver not breathing with the reclaim system there will be an equal flow in and out of the helmet and the helmet pressure will be the mean pressure between the two counterlungs since there will be an equal pressure drop in both the supply and return pipework. The flow through the helmet will be the same as the flow of gas through the rest of the system.

In the case of the diver breathing in with the rebreather, there will be no flow out of the helmet, the flow in will equal the diver's inspiratory rate and the flow through the $CO_2$ scrubber will be half the diver's inspiratory rate due to the action of the double counterlung. The pressure in the helmet will be reduced by the pressure drop in the supply pipework and the $CO_2$ scrubber. In the case of the diver breathing in with the reclaim system, the flow in the return pipework will be reduced by half the diver's inspiratory rate, the flow in the supply pipework will be increased by half the diver's inspiratory rate and the flow through the $CO_2$ scrubber will remain the same. The pressure in the helmet will be reduced only by the increase in the pressure drop in the return pipework due to the increased flow. This will be approximately one third of the reduction in helmet pressure for the rebreather. The case is similar when the diver breathes out but this time the helmet pressure increases in the reclaim system by one third of the increase in the rebreather. Therefore it is expected that the work of breathing of the reclaim system would be a third of the rebreather's work of breathing.

It should be noted that the gas flow rate through the reclaim system should be greater than half the diver's maximum inspiratory or expiratory rate because otherwise there will be periods when there is no flow in one or the other set of pipework between the helmet and the counterlungs. The explanation is as follows: assume that the change in volume in one counterlung is exactly matched by an equal change in volume in the other counterlung and assume that the diver's inhalation flow rate equals twice the flow rate of gas being circulated around the reclaim system: then, the flow out of the supply side counterlung to the diver is twice the flow of gas into the supply side counterlung so that half of the flow must be provided by the supply from the reclaim system and half of the flow is supplied from the counterlung thereby decreasing its volume with the rate of decrease of volume being the same as the rate of flow of the gas into it. Consequently, the exhaust counterlung in the return line will also decrease in volume at this rate which is the same rate at which gas is being removed from this counterlung via the return hose to the reclaim system. Since all of the gas flow to the reclaim system in this situation is being supplied from the return line counterlung via the return hose 14 (FIG. 3), there is consequently no flow through the pipeline between the helmet and the inlet of the return line counterlung. The significance of this condition is that if the diver's inhalation rate were to exceed twice the circulating gas flow for a short period of time, the diver would either draw back stale gas that had been expired during a previous breath from the pipeline between the helmet and the return line counterlung (in the absence of a non-return valve) or alternatively the diver would experience a shortage of supply (in the case where a non-return valve is provided). From the above explanation it is clear that it is best that the flow rate through the reclaim system should be greater than half the diver's maximum rate in order that he can achieve peak flow rates without suffering shortage of breath. It is to be noted that it is a common feature of breathing apparatus, particularly high pressure diving apparatus, that it should be possible to achieve peak breathing flow rates without unnecessary difficulty; however this requirement is not an essential feature of the present invention. In the case of the diver breathing sinusoidally at 75 liters per minute respiratory minute volume (r.m.v.) the diver's peak flow will be 236 liters per minute, the system's flow will therefore need to be 118 liters per minute.

Figure 5B:
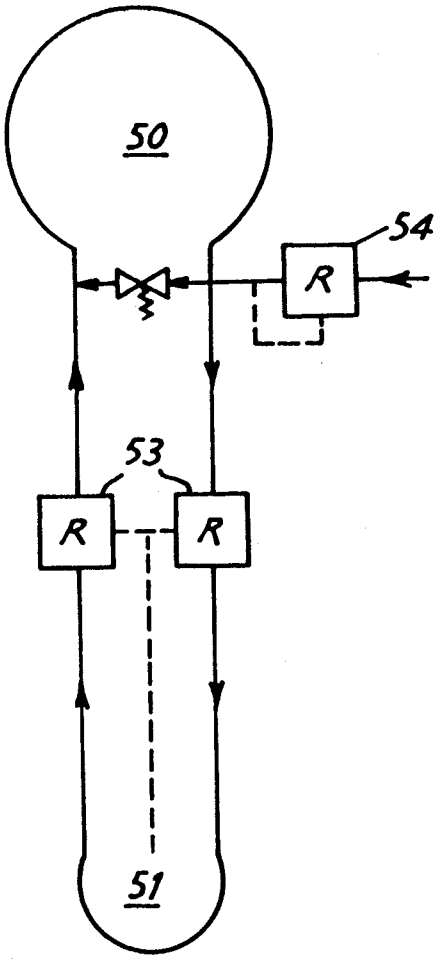
FIG. 5*b* illustrates a flow controlled loop recirculation system.
Figure 5A:
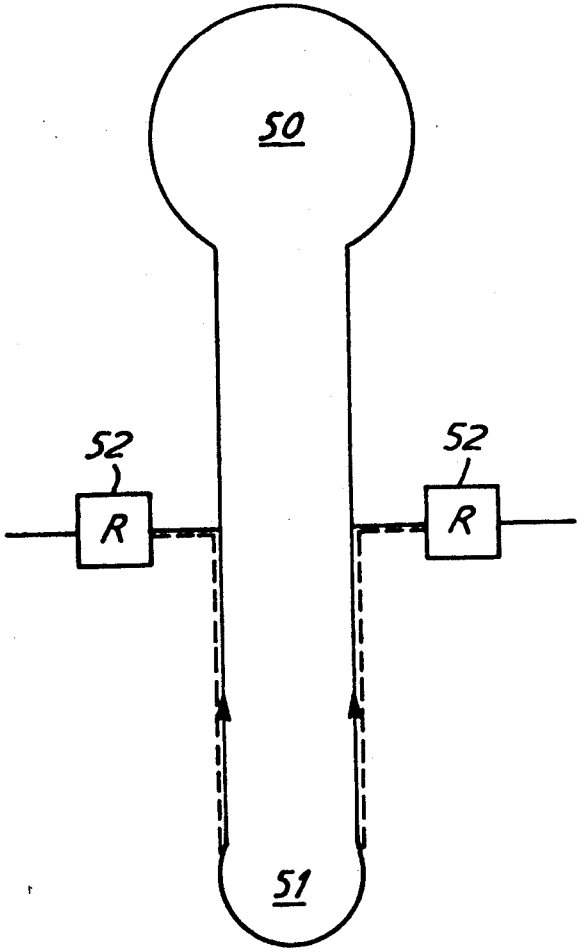
FIG. 5*a* illustrates an unrestricted loop recirculation system.

When the double counterlung 5,10 is used in conjunction with the gas reclaim system the supply and return flows to and from the backpack should be close to equal. If not, the counterlung will be either fully inflated or fully deflated for a portion of the breathing cycle. One approach (FIG. 5*a*) is to have no pressure regulating or flow regulating valves in the recirculating gas loop between the gas reprocessing unit 50 and the diver 51. This way the supply and return flows would both be equal to the flow through the gas recirculating pump. Supply and vent pressure regulating valves 52 would have to be connected to the loop to maintain the required volume of gas since, if the volume became too small, the counterlung would become completely deflated and there would be low helmet pressure. Conversely, if the volume of gas in the loop became too large, the counterlung would become fully inflated and there would be high helmet pressure. This approach has no regulators restricting the flow of recirculating gas, is simple and could be used for both a surface mounted system and a submersible mounted one.

The other approach (FIG. 5*b*) is to have valves 53 within the recirculating gas loop which regulate the flows to and from the diver to ensure that they are relatively equal. This approach could be incorporated into existing gas reclaim systems with few changes. System pressure would be maintained through a top-up valve 54.

Advantages of Design

Most of the advantages of this design are due to the steady flows for recirculation. These are:

a) Much smaller breathing umbilical hoses
b) A simpler system with fewer moving parts
c) Lower gas volumes in the system
d) Lower power pumps.

The fact that there are no supply or return demand valves incorporated in the helmet also has advantages. These are:

a) Lower helmet noise levels
b) Lower breathing resistance
c) No extra hoses to the helmet are required for the rebreather type bailout.

RECLAIM SYSTEMS

The system used should keep the supply and return flows as equal as possible to prevent the counterlungs being either full or empty for a substantial portion of the breathing cycle. However, because the counterlungs can shut off the supply flow when full, and the return flow when empty, the backpack can tolerate moderate differences between the supply and return flows without a great increase in the work of breathing.

Systems with the Flow of Recirculating Gas Unrestricted

Figure 6:
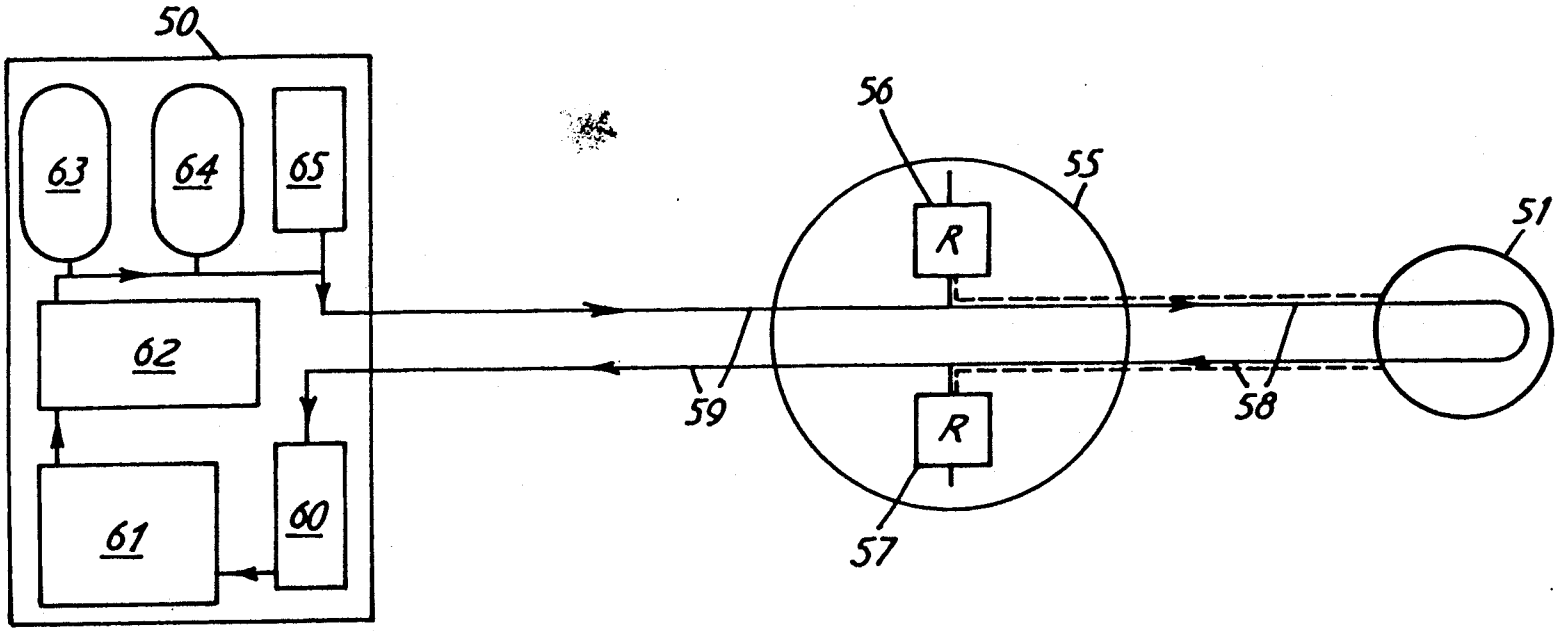
FIG. 6 illustrates an unrestricted flow system for one diver.

The system shown in FIG. 6 will have no pressure reducers or flow controllers R in the recirculating gas loop as these would cause further pressure drops in the system and increases the work done by the pump 61. In such a system the flow rate will be determined by the pump's characteristics, and, because there are no valves in the loop, the flow into the backpack will always be the same as the flow out.

However, if there is insufficient gas in the loop the counterlung will collapse, and if there is too much gas in the loop the counterlung will be fully inflated. A top-up valve 57 is required to be connected into the loop to add gas as it leaks from the system and when the diver's depth increases. Another, excess vent valve 56 is required to bleed gas from the loop if the diver's depth decreases rapidly. This is best achieved by placing the valves in the diving bell or other submersible 55 which detect when the counterlung is fully inflated or deflated and then add or take gas as required. This can be achieved using simple commercially available valves.

Gas is drawn into the reprocessing unit 50 by the pump 61 through a water trap 60 and pumped through a $CO_2$ scrubber 62 past the oxygen makeup 63, back-up gas supply 64 and gas monitor 65 to return to the umbilical 59 leading to the submersible 55 and thence to the diver's umbilical 58. The submersible and surface mounted equipment would be similar to existing reclaim systems with the following changes: there would be no receiving or volume tanks, a smaller pump 61, and the oxygen makeup 63 would need to be fully automatic, since the small system volume would be relatively sensitive to the rate of oxygen consumption. If the pump was sized correctly a number of divers could operate from one system as long as their depths were similar. As the degree of the depth difference increased, however, the shallower diver would get a greater supply flow and the deeper diver would get a greater return flow. If this became a limitation independent systems would be required for each diver.

Systems with the Flow of Recirculating Gas Controlled

Figure 7:
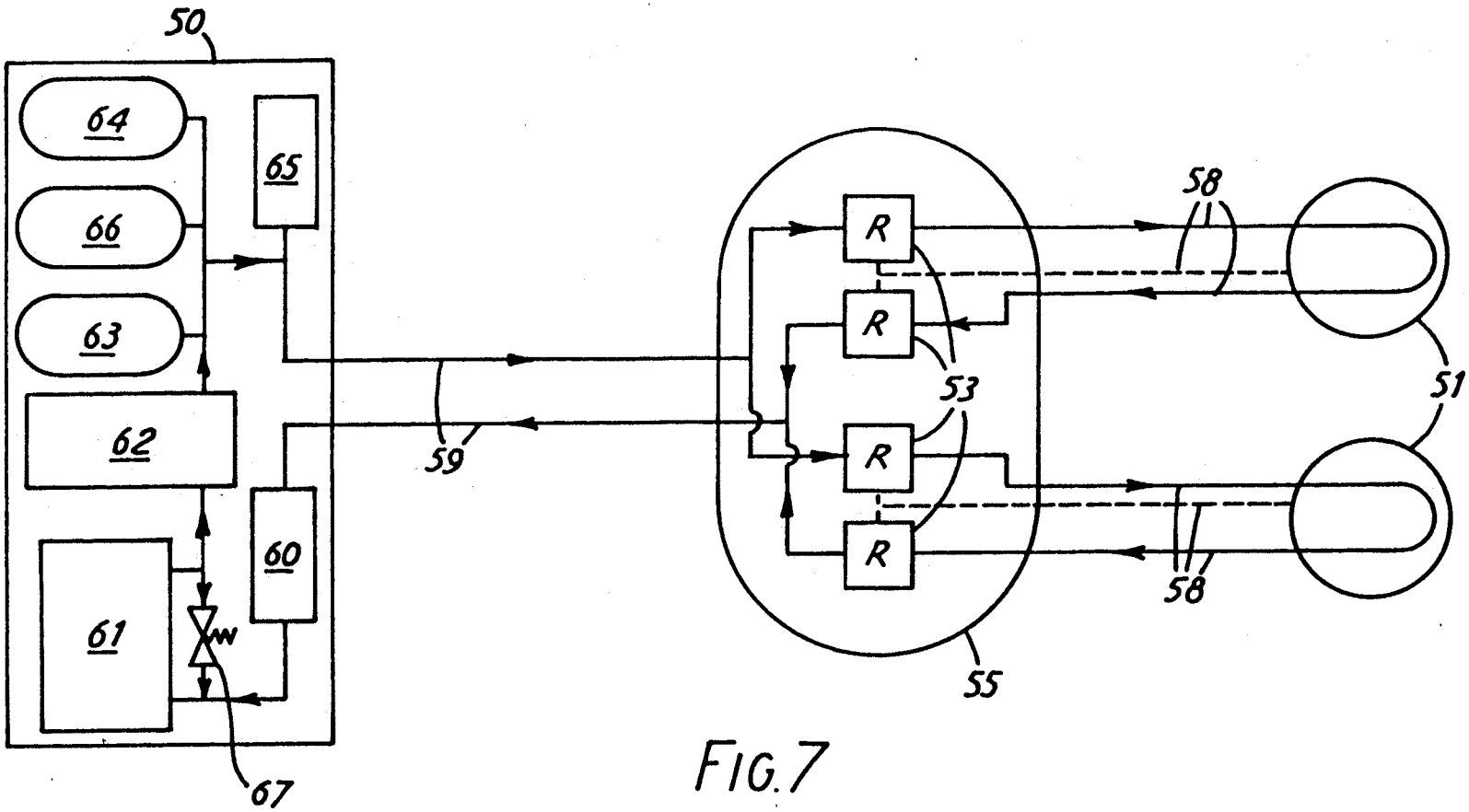
FIG. 7 illustrates a controlled flow system for two divers.

An alternative design which could use existing gas return line systems, with some modification, would have valves in the diving bell which controlled the flow to and from the diver—see FIG. 7. This can be achieved using commercially available valves. These valves would create a pressure drop in the recirculating gas loop so a more powerful pump 61 with an excess flow return valve 67 would be required than in the initial system (as well as a supply 66 of top-up gas). The pressure drops would still be considerably less than in existing systems. One advantage of this system over the initial system is that if a number of divers were operating from the same system at different depths only the diving bell valves 53 would need to be duplicated.

To modify an existing gas reclaim system would require the following items:

a) Backpack
b) Modified helmet
c) Smaller divers' umbilical hoses
d) Bell control valves
e) Modified pump.

The pump would require modification to increase the gas flow rate and reduce the pressure rise. The could be achieved by changing the ratio between pump and motor speed, and reducing the relief valve pressures. If desirable, any gas accumulators in the system could be removed, thus reducing the quantity of gas required to pressurise the system.

For the system shown in FIG. 7, with the diver at 500 meters and a total system flow of 240 liters per minute, it is calculated that the system pressure drop will be 23 bar. This requires a higher flow rate than existing two diver systems but the pressure drop is substantially reduced so that the work done by the pump is actually reduced by around 25%. In this system, at 500 meters, the supply pressure at the submersible should be at 6 bar above the diver's ambient pressure and the return pressure at the submersible should be 2 bar below the diver's ambient pressure.

Submersible Mounted System

Figure 8:
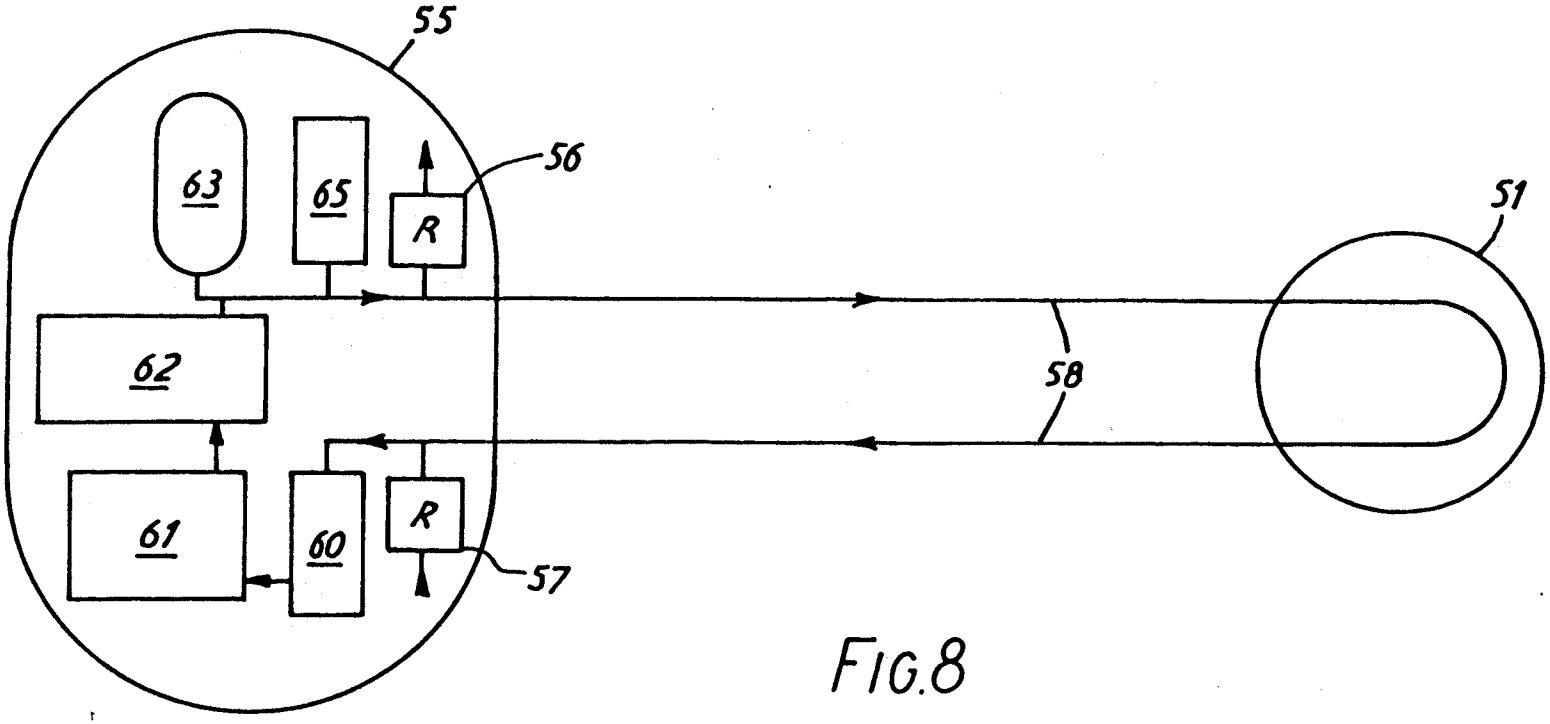
FIG. 8 illustrates a submersible-mounted system for one diver.

The system with the flow of recirculating gas unrestricted could be adapted to be installed on a submersible vessel if required—see FIG. 8. It would require only a small pump 61 since the only appreciable pressure drop within the system would be due to the diver's umbilical 58. It would also require $CO_2$ scrubbers 62 and an oxygen makeup system 63, 64 which were independent of the submersible's life support system. These could be used as a backup for the submersible when not used for diving.

Submersible's Valves in Unrestricted Flow System

Figure 9:
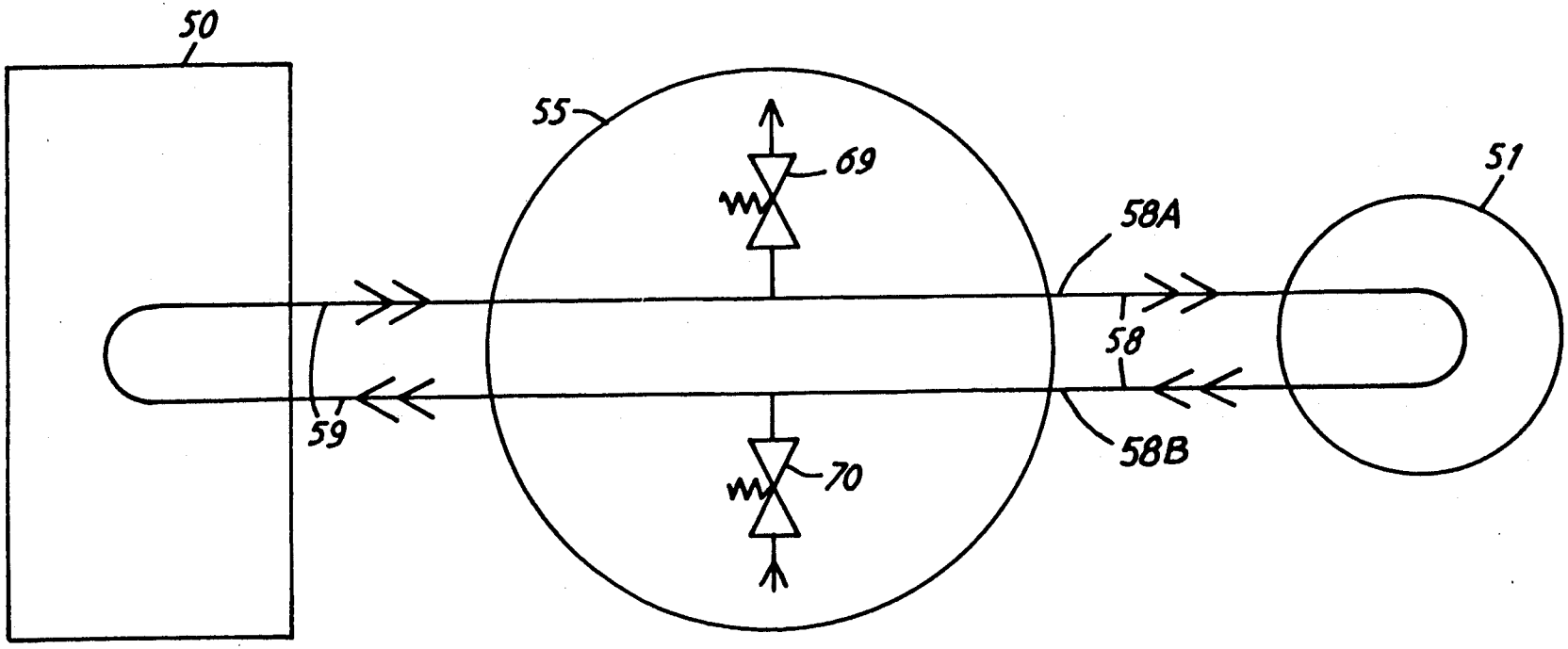
FIG. 9 illustrates an unrestricted flow system valve arrangement.

Two valves are required in the submersible: one, to vent when the diver's counterlung is full, and one, to add gas when the counterlung is empty. This is achieved by simple relief valves 69 and 70 as shown in FIG. 9. When the counterlung is full the supply umbilical 58A will be shut off and pressure will build up in this line causing the vent valve 69 to open. When the counterlung is empty the return umbilical 58B will be shut off and the pressure in this line will drop causing the top-up valve 70 to open. The relief valves are set to ensure that there is sufficient pressure differential for the range of submersible depths and diver excursions. The top-up and vented gas would be added to or taken from the submersible's atmosphere.

For the system shown in FIG. 6 it has been calculated that when operating with the diver at 500 meters with a system flow of 120 liters per minute the system pressure drop will be 29 bar. The system would require the excess vent valve to open at 11.5 bar above the ambient pressure in the submersible, and the top-up valve to open at 5.5 bar below the ambient pressure in the submersible.

For the system shown in FIG. 8 larger hoses are used in the diver's umbilical to achieve a system pressure drop of 6 bar at 500 meters. In this system the excess vent valve would be set at 7 bar and the top up valve set at 3 bar.

Submersible's Valves in Controlled Flow System

For this system both the supply and return flows need to be controlled and matched to the diver's depth. This is achieved by maintaining a constant pressure drop across both the diver's supply and return umbilicals. The ambient pressure at the diver is monitored by using a "pneumo" hose and a fixed pressure differential is maintained between this pressure and both the supply and return pressures at the submersible. The pressure differentials required will depend on the submersible's depth. When the counterlung is either full or empty the flow in one line will stop, otherwise the supply and return flows will be constant.

Figure 10:
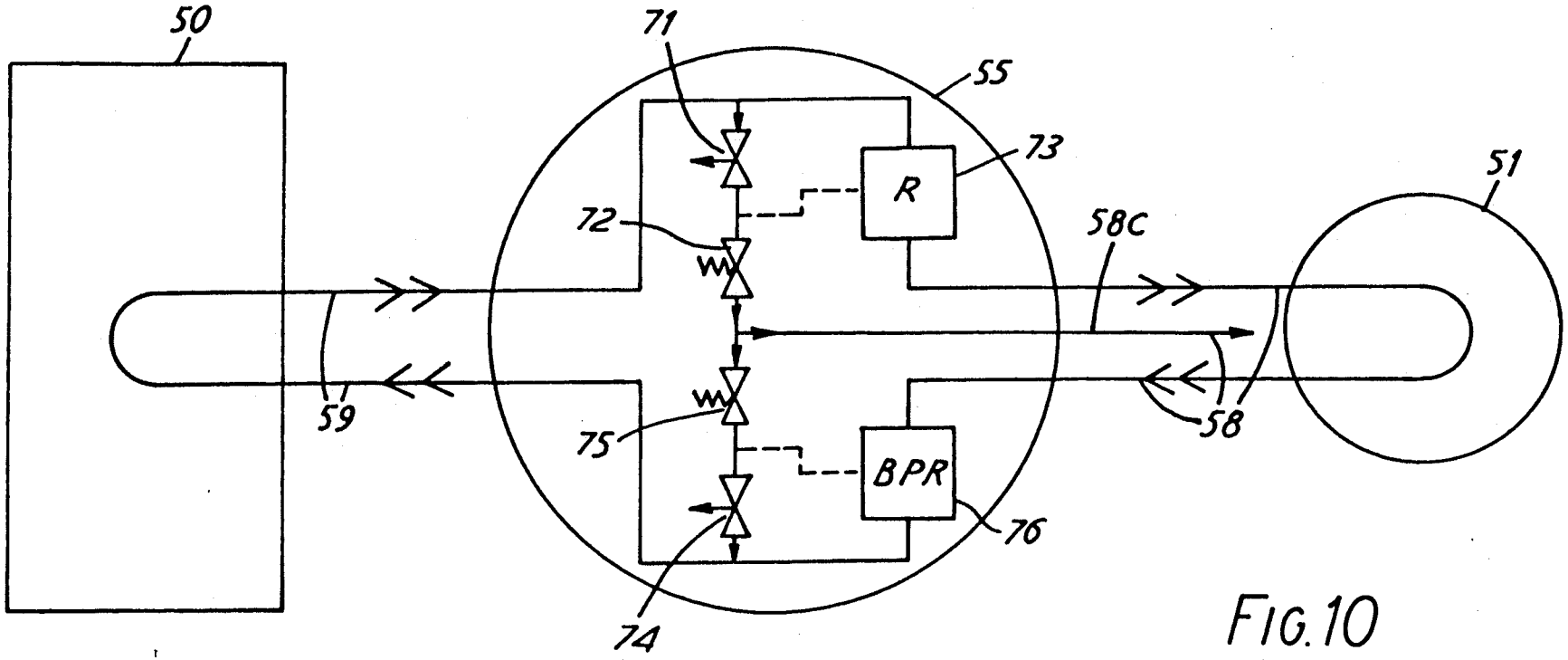
FIG. 10 illustrates a controlled flow system valve arrangement.

FIG. 10 shows the layout for these valves. A first needle valve 71 bleeds a very small flow of gas from the supply line 58*a*. This flows through a variable relief valve 72 to the pneumo hose 58*c* so that it bubbles out of the hose at the diver 51. As the pressure drop in the hose will be negligible, the pressure in the hose at the submersible will be the diver's ambient pressure. A proportion of the gas bled from the supply line is bled back into the return line via a second variable relief valve 75 and a second needle valve 74.

A dome loaded regulator 73 downstream of the supply bleed 71 controls the supply pressure to the diver. The reference pressure for this regulator is taken from upstream of the first relief valve 72. This pressure will be above the pneumo hose pressure by the amount of the relief valve opening pressure. Similarly a dome loaded back pressure regulator 76 controls the divers return pressure. This is upstream of the return bleed. The reference pressure for this regulator is downstream of the second relief valve. This pressure will be below the pneumo hose pressure by the amount of the opening pressure of the second relief valve 75.

Incorporating the Counterlungs into a Gas Reclaim System

Several systems in which the counterlung could be used are described above. However, any system where the gas flows to and from the user are maintained at similar rates and which can accommodate the supply or return gas flow being shut off without excessive increases in the supply pressure to the user, or decrease in the return pressure from the user, could be used.

Figure 11:
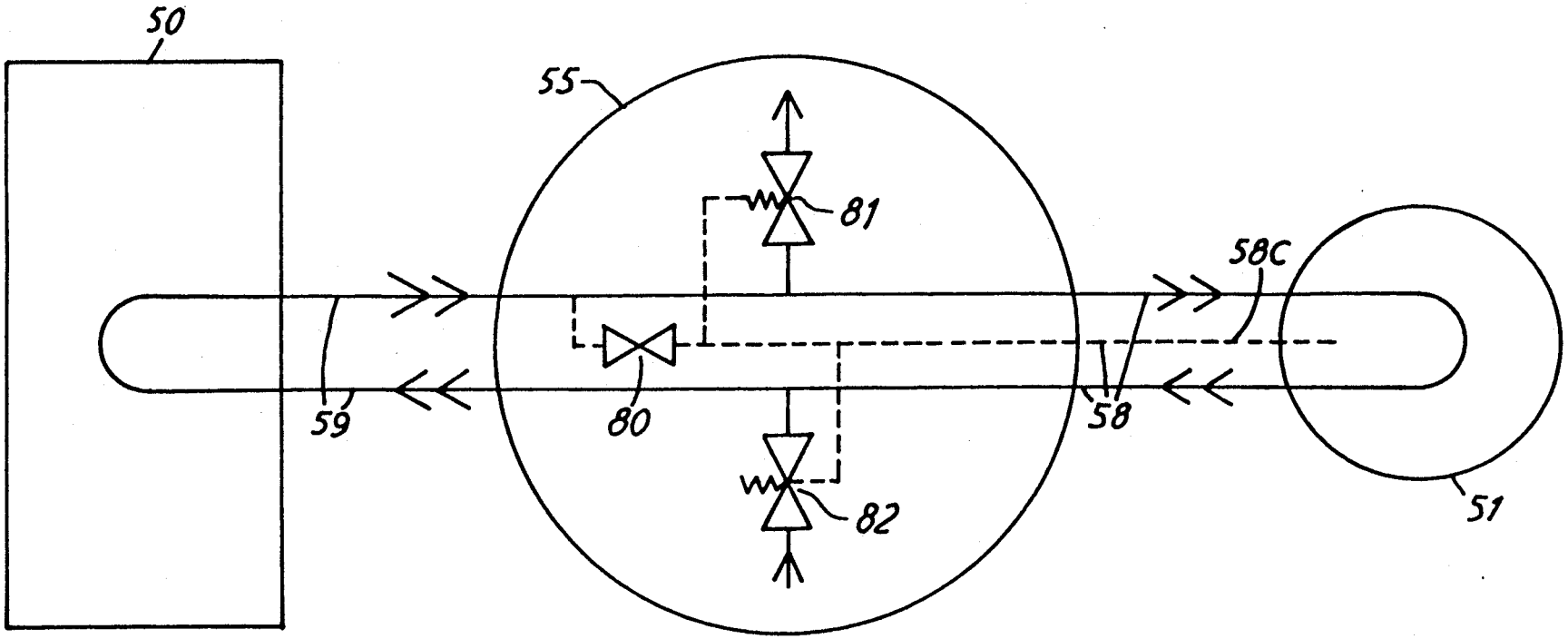
FIG. 11 illustrates a development of the volume-controlled/unrestricted flow system valve arrangement.

A possible development of the volume controlled-/unrestricted flow system would be to reference the pressure at which the relief valves open to the diver's ambient pressure, as shown in FIG. 11. In this system a needle valve 80 bleeds a very small flow of gas from the supply line to a "pneumo" hose 58*c* so that it bubbles out of the hose at the diver 51. The vent and supply relief valves 81 and 82 are then loaded by the pressure in the pneumo hose 58*c* rather than the pressure in the submersible 55. These relief valves would be set to open when the normal pressure drop in the respective hose was exceeded. Because the valves are referenced to the diver's ambient pressure it would not be necessary to take into account the possible differences between the ambient pressure at the submersible and the ambient pressure at the diver.

Incorporating the Counterlungs into a Closed or Semi-closed Circuit Rebreather The counterlungs could be incorporated into any form of rebreather backpack. If the rebreather is to be used in conjunction with a gas reclaim system then it will be necessary to isolate the reclaim system from the counterlungs, to allow the breathing gas to circulate through the backpack, and to open the gas cylinders in the backpack simultaneously. If the rebreather is pressurised when not in use, to prevent the ingress of water, then both the supply and return counterlungs will need to be isolated from the rebreather when the gas reclaim system is in use. This could be achieved by a series of valves that are either physically connected or pneumatically operated when a valve is opened.

As stated before the key to the concept is to have situated on the diver two counterlungs/breathing bags 5,10 which are constrained in such a way that a change in the volume contained in either one will cause a similar change in volume in the other. One counterlung/-breathing bag 5 will be connected to the supply side of the diver's breathing circuit and the other, 10, to the return side of the diver's breathing circuit. Connected to the counterlungs/breathing bags would be valves 4,11 which would shut off the supply of breathing gas from the diver's umbilical when they were close to their maximum volume, and would shut off the return of the expired gas to the diver's umbilical when they are close to their minimum volume. This can then be incorporated in a gas reclaim system as well as a closed or semi-closed circuit rebreather.

Figure 12:
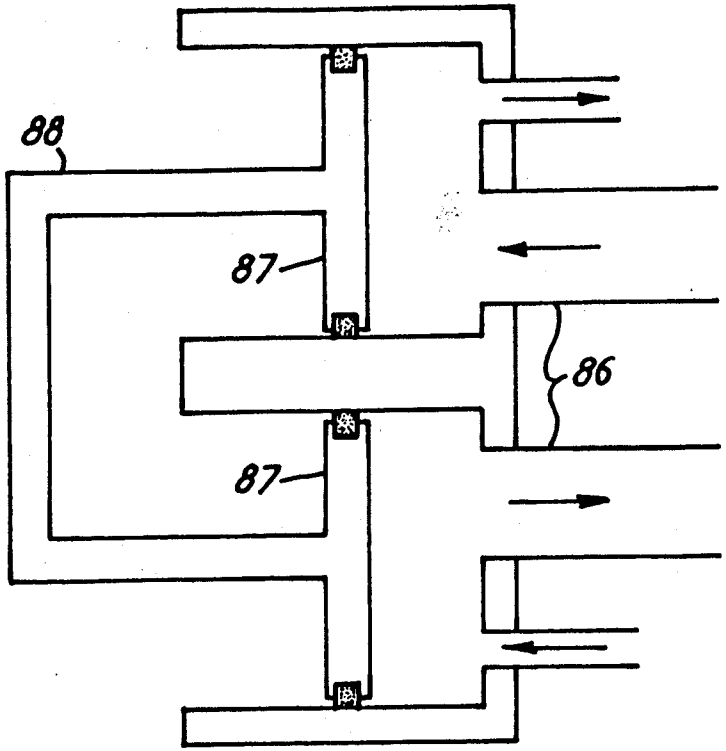
FIG. 12 illustrates an alternative double counter lung, with two pistons connected together and sliding in respective cylinders.

One alternative method of achieving the basic requirements is to connect two pistons 87 (sliding in respective cylinders 86) together as shown in FIG. 12 by means of a connecting bar 88. Any change in volume in one cylinder would be matched by a similar change in the other. The pistons could be sealed by either a sliding seal or a diaphragm. Valves would be incorporated which were controlled by the position of the pistons so that the supply and return flow in the diver's umbilical would be stopped when required.

Figure 13:
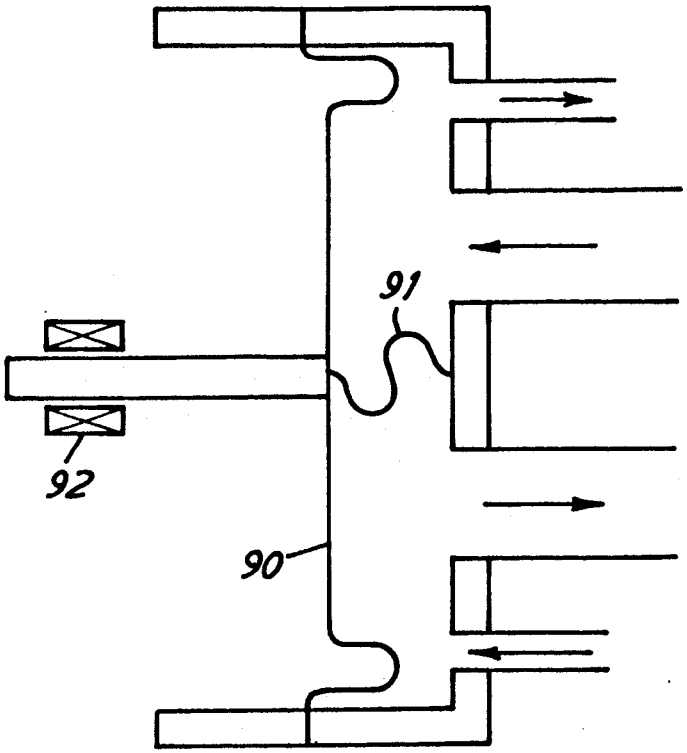
FIG. 13 illustrates an alternative double counterlung, with a single diaphragm enclosing two counterlungs and being guided by a guide rod.

Another alternative method (shown in FIG. 13) of achieving the basic requirements would be to use a single diaphragm 90 to enclose the two counterlungs/-breathing bags separated by a separating membrane 91 but, rather than being hinged as initially described, it is guided by a rod in a guide 92 so that it can only move to-and-fro in one direction and cannot tilt.

Clearly, there are applications where the counterlung could be used just in conjunction with a rebreather or just in conjunction with a reclaim system.

It is to be understood that the apparatus will have application in breathing apparatus which is not for use underwater.

The systems described above should be easier and cheaper to manufacture, maintain and operate from existing systems because of the smaller number of components and moving parts in the design, while requiring less space, power and gas.

The design is very flexible in that it can be incorporated into existing gas reclaim systems and can be mounted on a submersible vessel if required.

Key to Figures

1. Supply hose.
2. Loaded non-return valve.
3. Manual supply shut-off valve (normally open).
4. Automatic supply shut-off valve.
5. Supply counterlung.
6. Pressure relief valve.
7. Counterlung hinge.
8. Hose to helmet.
9. Hose from helmet.
10. Return counterlung.
11. Automatic return shut-off valve.
12. Manual return shut-off valve (normally open).
13. Suction relief valve.
14. Return hose.
15. Changeover handle.
16. Bailout return shut-off valve (normally closed).
17. Bailout oxygen valve (normally closed).
18. Oxygen cylinder.
19. Oxygen flow restrictor.
20. $CO_2$ scrubber.
21. Bailout top-up gas shut-off valve (normally closed).

22. Top-up gas cylinder.
23. Pressure reducer.
24. Automatic top-up gas valve.
25. Sealed backpack section.
26. Open backpack section.
27. Freeflow hose to helmet.
28. Flexible membrane.
29. Hinged sheet.
30. Helmet.
31. Supply non-return valve.
32. Supply shut-off valve (normally open).
33. Return shut-off valve (normally open).
34. Return non-return valve.
35. Freeflow non-return valve.
36. Freeflow shut-off valve (normally closed).
37. Freeflow vent valve (normally closed).
38. Vent non-return valve.
41. Centre line.
42. Fixed sheet.
43. Bellows.
50. Gas reprocessing unit.
51. Diver.
52. Pressure regulating valves.
53. Flow control regulators.
54. Top-up regulator.
55. Submersible.
56. Excess vent valve.
57. Top-up valve.
58. Diver umbilical.
59. Submersible umbilical.
60. Water trap.
61. Pump.
62. $CO_2$ scrubber.
63. $O_2$ make-up.
64. Backup gas.
65. Gas monitor.
66. Top-up gas.
67. Excess flow return valve.
69. Vent relief valve.
70. Top-up relief valve.
71. First needle valve.
72. First relief valve.
73. Dome loaded regulator.
74. Second needle valve.
75. Second relief valve.
76. Dome loaded back pressure regulator.
80. Needle valve.
81. Diver referenced vent relief valve.
82. Diver referenced top-up relief valve.
86. Cylinders.
87. Pistons.
88. Connecting bar.
90. Diaphragm.
91. Separating membrane.
92. Guide.
105. Counterlung partition.

I claim:

1. Breathing apparatus for use in recirculation of a breathing gas and having a supply line for supply of the gas to a user and a return line for return of exhaust gas from the user to be recirculated; the apparatus including a first variable volume chamber in the supply line and a second variable volume chamber in the return line; said supply line comprising i) an inlet flow line to said first chamber for supply of said breathing gas to said first chamber and ii) a separate outlet flow line from said first chamber for flow of said breathing gas from said first chamber to the user; said return line being separate from said supply line and comprising i) an inlet flow line to said second chamber for flow of said breathing gas from the user to said second chamber and ii) a separate outlet flow line from said second chamber for flow of said exhaust gas from said second chamber to be recirculated; the chambers in the supply and return lines being capable of changing volume in unison with the user's breathing to accommodate a change in gas volume in the apparatus due to the user's breathing action; means for causing the volumes of the first and second chambers to increase and decrease together in such a way that the variation of volume of either the first or second chamber is accompanied by a similar variation in the volume of the other chamber and the first and second chambers are at a maximum volume together and at a residual volume together; and first means to shut off the supply line when the first and second chambers contain a maximum operational volume of breathing gas and second means to shut off the return line when the first and second chambers contain a residual volume.

2. The apparatus according to claim 1 wherein at least one of said variable volume chambers is in the form of a counterlung.

3. The apparatus according to claim 2 wherein the counterlung includes a double counterlung comprising a single body which includes the first and second chambers.

4. The breathing apparatus according to claim 1, having a scrubber means in the loop flow line for reprocessing gas by removal of carbon dioxide.

5. The breathing apparatus according to claim 4, and further having pump means in the loop flow line for driving said breathing gas through the apparatus.

6. An apparatus as defined in claim 1 wherein the first and second means include first and second valves, respectively.

7. The breathing apparatus according to claim 1, wherein said apparatus is adapted for use by a diver.

* * * * *